US008485205B2

(12) United States Patent
Fountain et al.

(10) Patent No.: US 8,485,205 B2
(45) **Date of Patent: *Jul. 16, 2013**

(54) DISHWASHER WITH ROTATING ZONE WASH SPRAYERS

(75) Inventors: Jordan Robert Fountain, Saint Joseph, MI (US); Sathish Andrea Sundaram, Benton Harbor, MI (US); Bryan E. Wagenknecht, Pittsburgh, PA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/597,354

(22) Filed: Aug. 29, 2012

(65) Prior Publication Data

US 2012/0325276 A1 Dec. 27, 2012

Related U.S. Application Data

(63) Continuation of application No. 12/433,016, filed on Apr. 30, 2009, now Pat. No. 8,347,898.

(51) Int. Cl.

| | |
|---|---|
| ***B08B 3/00*** | (2006.01) |
| ***B08B 3/12*** | (2006.01) |
| ***B08B 6/00*** | (2006.01) |

(52) U.S. Cl.
USPC ..... 134/180; 134/56 D; 134/57 D; 134/58 D; 134/172; 134/174; 134/176; 134/179; 134/181

(58) Field of Classification Search
USPC ..... 134/56 D, 57 D, 58 D, 172, 176, 134/179, 180, 181
See application file for complete search history.

(56) References Cited

U.S. PATENT DOCUMENTS

| | | | | |
|---|---|---|---|---|
| 1,223,380 | A * | 4/1917 | Garis-Cochrane | 134/99.2 |
| 7,270,132 | B2 * | 9/2007 | Inui et al. | 134/56 D |
| 8,113,222 | B2 * | 2/2012 | Bertsch et al. | 134/181 |

FOREIGN PATENT DOCUMENTS

| | | | |
|---|---|---|---|
| EP | 1090579 | A1 * | 4/2001 |
| GB | 2151464 | A * | 7/1985 |
| JP | 04049935 | A * | 2/1992 |
| JP | 11076127 | A * | 3/1999 |

* cited by examiner

*Primary Examiner* — Michael Barr
*Assistant Examiner* — Charles W Kling
(74) *Attorney, Agent, or Firm* — Jacqueline R. Lin; McGarry Bair PC

(57) ABSTRACT

An automatic dishwasher has a rotatable spray arm and at least one rotatable sprayer, a drive link coupling the rotation of the rotatable spray arm and the at least one rotatable sprayer, and a drive for directly driving at least one of the rotatable spray arm and the at least one rotatable sprayer.

20 Claims, 7 Drawing Sheets

DISHWASHER WITH ROTATING ZONE WASH SPRAYERS

CROSS-REFERENCE TO RELATED APPLICATION

This application is a continuation of U.S. patent application Ser. No. 12/433,016, filed Apr. 30, 2009, which is incorporated herein by reference in its entirety.

BACKGROUND OF THE INVENTION

Contemporary automatic dishwashers for use in a typical household include a tub and an upper and lower rack or basket for supporting soiled utensils within the tub. A spray system and a filter system are provided for re-circulating wash liquid throughout the tub to remove soils from the dishes. Typically, larger dishes such as casserole dishes that have a propensity to be heavily soiled are carried on the lower rack and lighter soiled dishes such as cups and glasses are provided on an upper rack. The racks are generally configured to be moveable in or out of the tub for loading and unloading.

The spray systems have rotating spray arms and sprayers that are rotated by the propulsion force of the exiting wash liquid, which is dependent on the pumping of the wash liquid. Thus, the rotation of the spray arms and sprayers is directly linked to the spraying of wash liquid.

BRIEF DESCRIPTION OF THE INVENTION

In one embodiment, the invention relates to an automatic dishwasher configured to perform a cycle of operation to clean utensils. The dishwasher comprises a tub defining a wash chamber having an open face for receiving utensils for washing, wherein the tub comprises a bottom wall and a rear wall extending from and perpendicular to the bottom wall, a closure element for closing the open face, a first dish rack located within the wash chamber and comprising a bottom and a peripheral side wall extending upwardly from the bottom, a rotatable spray arm provided on the bottom wall beneath the first dish rack and having a primary spray passing through the bottom of the first dish rack to define a first wash zone in the wash chamber, at least one rotatable sprayer provided on the rear wall and having a primary spray defining a second wash zone in the wash chamber, a drive link coupling the rotation of the rotatable spray arm and the rotatable sprayer, and a driver coupled to and moving one of the rotatable spray arm, rotatable sprayer, and drive link, and thereby simultaneously rotating the rotatable spray arm and the rotatable sprayer.

DESCRIPTION OF AN EMBODIMENT OF THE INVENTION

Figure 1:
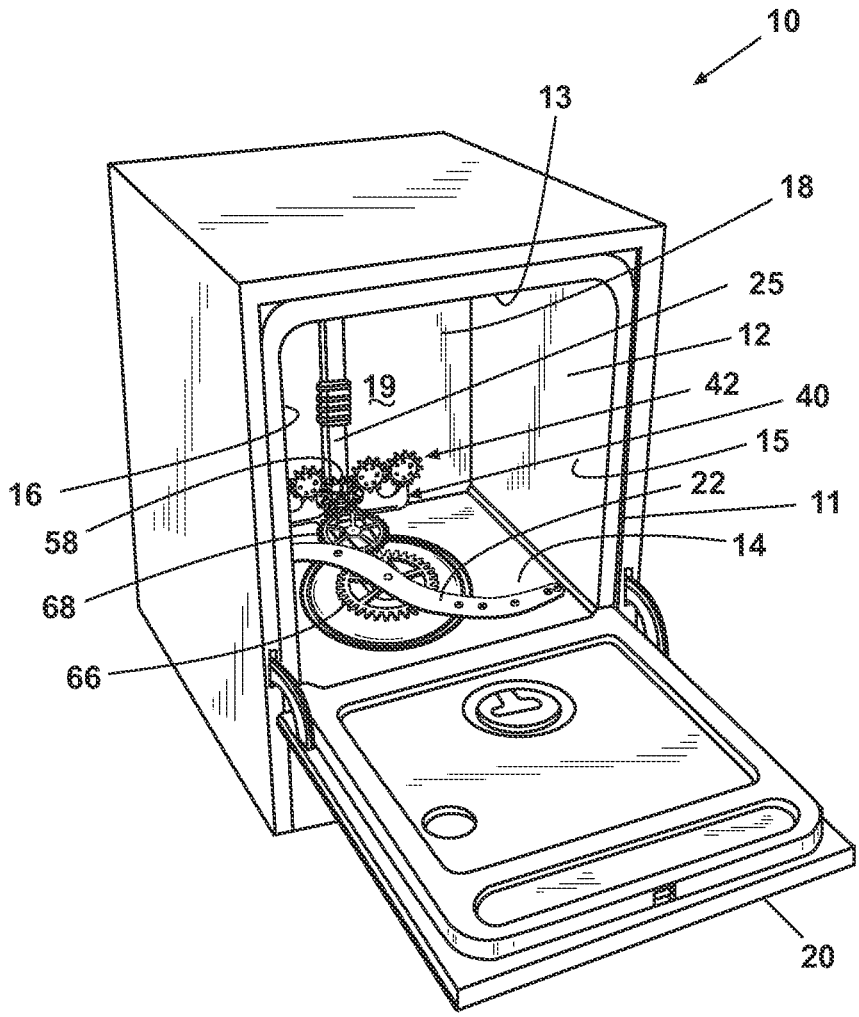
FIG. 1 is a perspective view of a dishwasher having a rotatable spray arm, at least one sprayer, and a drive link coupling the rotation of the spray arm and sprayer in accordance with a first embodiment of the invention.

Referring now to the drawings, wherein like numerals indicate like elements throughout the views, FIG. 1 illustrates an automatic dishwasher 10 according to a first embodiment of the invention. The dishwasher 10 comprises a cabinet in which is provided an interior tub 12 having a top wall 13, a bottom wall 14, and two side walls 15, 16, and a rear wall 18, which form an interior wash chamber 19, with an open face 11, for washing utensils for cleaning. A closure element is provided for selectively closing the open face 11 and is illustrated as a door 20, which may be pivotally attached to the dishwasher 10 for providing accessibility to the wash chamber 19 for loading and unloading utensils or other washable items.

As used in this document, the term utensils is meant to be generic and cover any item, singular or plural, that may be washed in a dishwasher, including, without limitation: silverware, dishes, plates, bowls, glassware, pots, and pans.

A spray manifold 40 may be positioned on the rear wall 18 of the interior tub 12. At least one rotatable sprayer 42 is provided in the interior tub 12 in fluid communication with the spray manifold 40.

Figure 2:
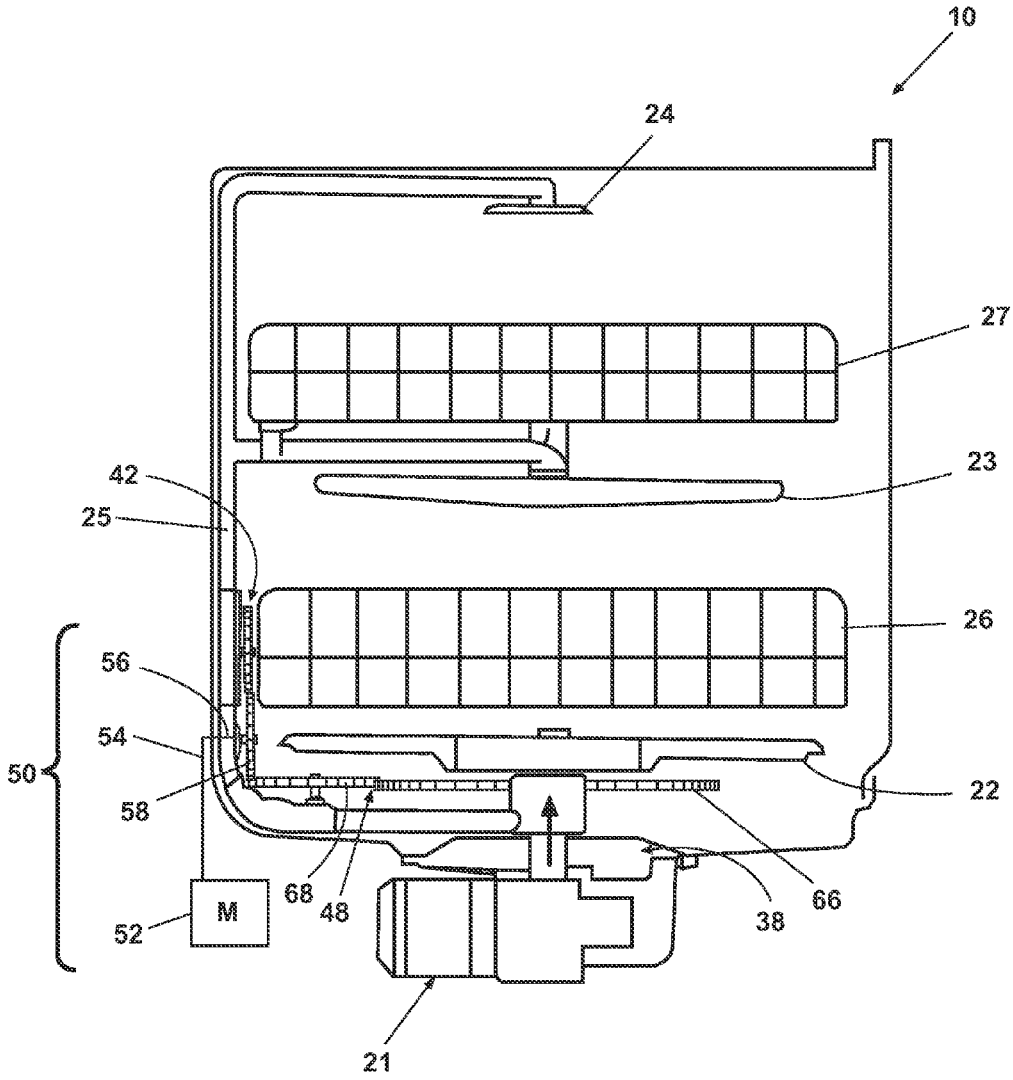
FIG. 2 is a schematic, cross-sectional view of the dishwasher shown in FIG. 1.

Referring to FIG. 2, the bottom wall 14 of the dishwasher can be sloped to define a lower tub region or sump 38 of the tub 12. A first dish rack 26 located within the wash chamber 19 has a bottom and a peripheral side wall extending upwardly from the bottom. A second dish rack 27 may optionally be located above the first dish rack 26.

A pump assembly 21 can be located in or around a portion of the bottom wall 14 and in fluid communication with the sump 38 to draw wash liquid from the sump 38 and to pump the liquid to at least one spray arm 22. Additionally, the dishwasher 10 may have a mid-level spray arm 23 and/or an upper spray arm 24, with the liquid selectively pumped through a fluidly-connected supply tube 25 to the spray arms 22-24 for selective washing.

In this exemplary embodiment, the first spray arm 22 is positioned beneath the first dish rack 26, the mid-level spray arm 23 is positioned between the upper dish rack 27 and the lower dish rack 26, and the upper spray arm 24 is positioned above the upper dish rack 27. The lower spray arm 22 and the middle spray arm 23 spray a flow of wash liquid in a generally upward direction over a portion of the interior of the tub 12. The upper spray arm 23 sprays a flow of wash liquid in a generally downward direction.

The dishwasher 10 may have a drive link 48 operably coupling the rotation of at least one rotatable spray arm 22 and at least one rotatable sprayer 42. The drive link 48 may be one or more gears, crank, belts, a combination thereof, or any other suitable linkage system. A driver 50 may be coupled to and moving one of the rotatable spray arm 22, rotatable sprayer 42, and drive link 48, and thereby simultaneously rotates the rotatable spray arm 22 and the rotatable sprayer 42. The driver 50 may have a motor 52 located virtually in any location, for example inside of the tub 12, or behind or under the tub 12 of the dishwasher 10.

An exemplary embodiment illustrated in FIG. 2, shows the motor 52 located behind the tub 12 and coupled through a belt 54 to a drive shaft 56, which in turn is coupled with at least one sprayer 42. However, the motor 52 may be any suitable direct or an indirect motor, some non-limiting examples are: a brushless permanent magnet (BPM) motor, an induction motor and a permanent split capacitor (PSC).

Figure 3:
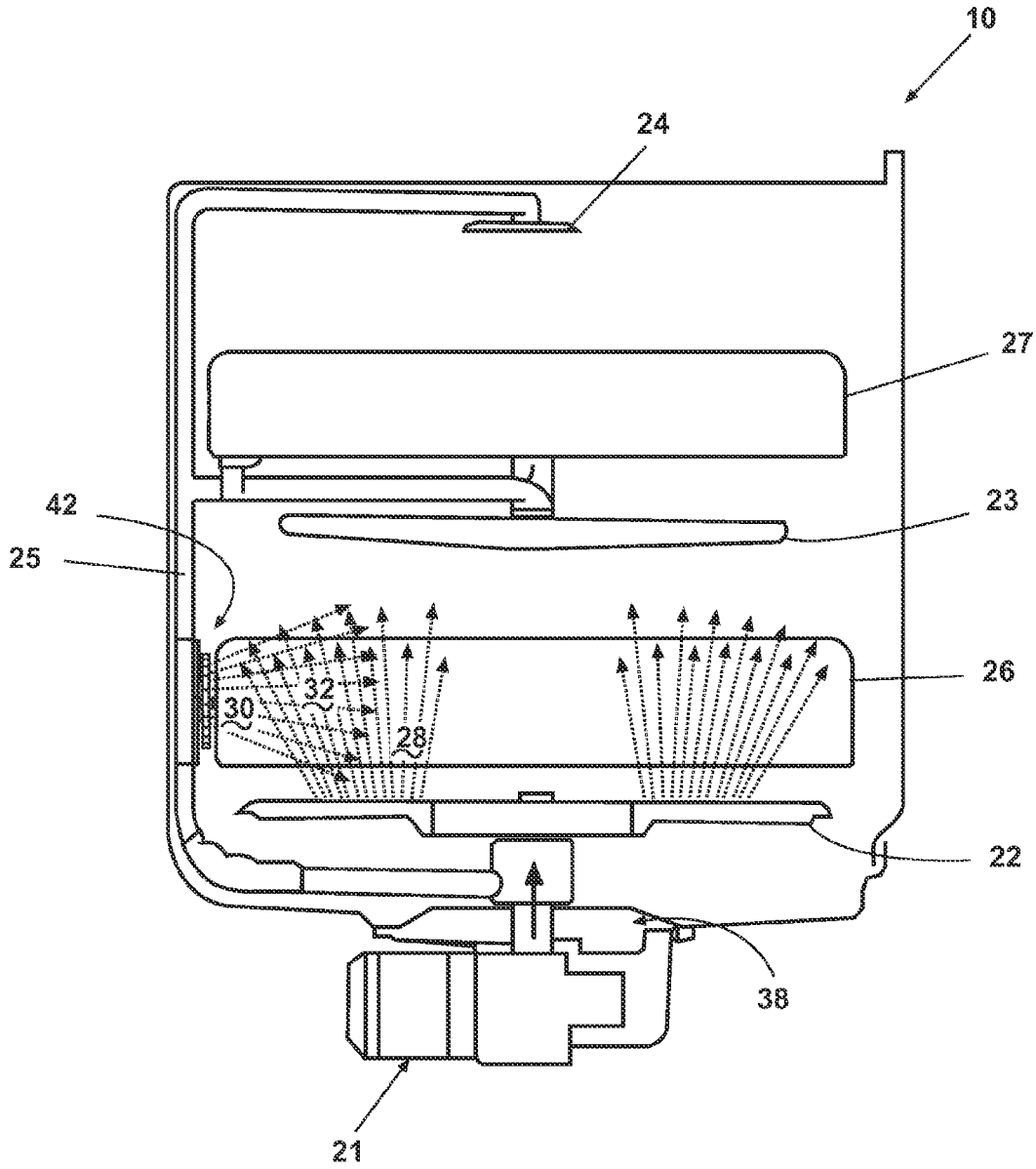
FIG. 3 is a schematic, cross-sectional view of the dishwasher shown in FIGS. 1 and 2 with some details removed for clarity.

Turning now to FIG. 3, in which some details are removed for clarity, the spray from the lower spray arm 22 can have a primary spray passing through the bottom of the first dish rack 26 to define a first wash zone 28 in the wash chamber 19. Each of the at least one rotatable sprayers 42 has a primary spray, the collection of which defines a second wash zone 30 in an area bounded by the peripheral side wall of the first dish rack 26. Alternatively, the primary spray of the at least one rotatable sprayers 42 passes directly through a portion of the peripheral side wall to locate the second wash zone 30 interiorly adjacent the portion of the peripheral side wall of the first dish rack 26. The first and second wash zones 28, 30 overlap to define a third zone 32.

The first and second wash zones 28, 30 may have the same or different characteristics, such as force, volumetric flow rate, etc. The third zone 32 has at least one of a greater intensity, pressure, and volumetric flow rate than each of the first and second wash zones 28, 30 to form a more intensified wash zone. Thus, the third wash zone 32 may be designed to enable heavily soiled utensils, such as casserole dishes, to receive the traditional spray arm wash, as well as an additional concentrated wash. Thus, a dishwasher having such a zone will not only provide better washing performance for heavily soiled dishware, but will provide overall improved wash performance.

Figure 4:
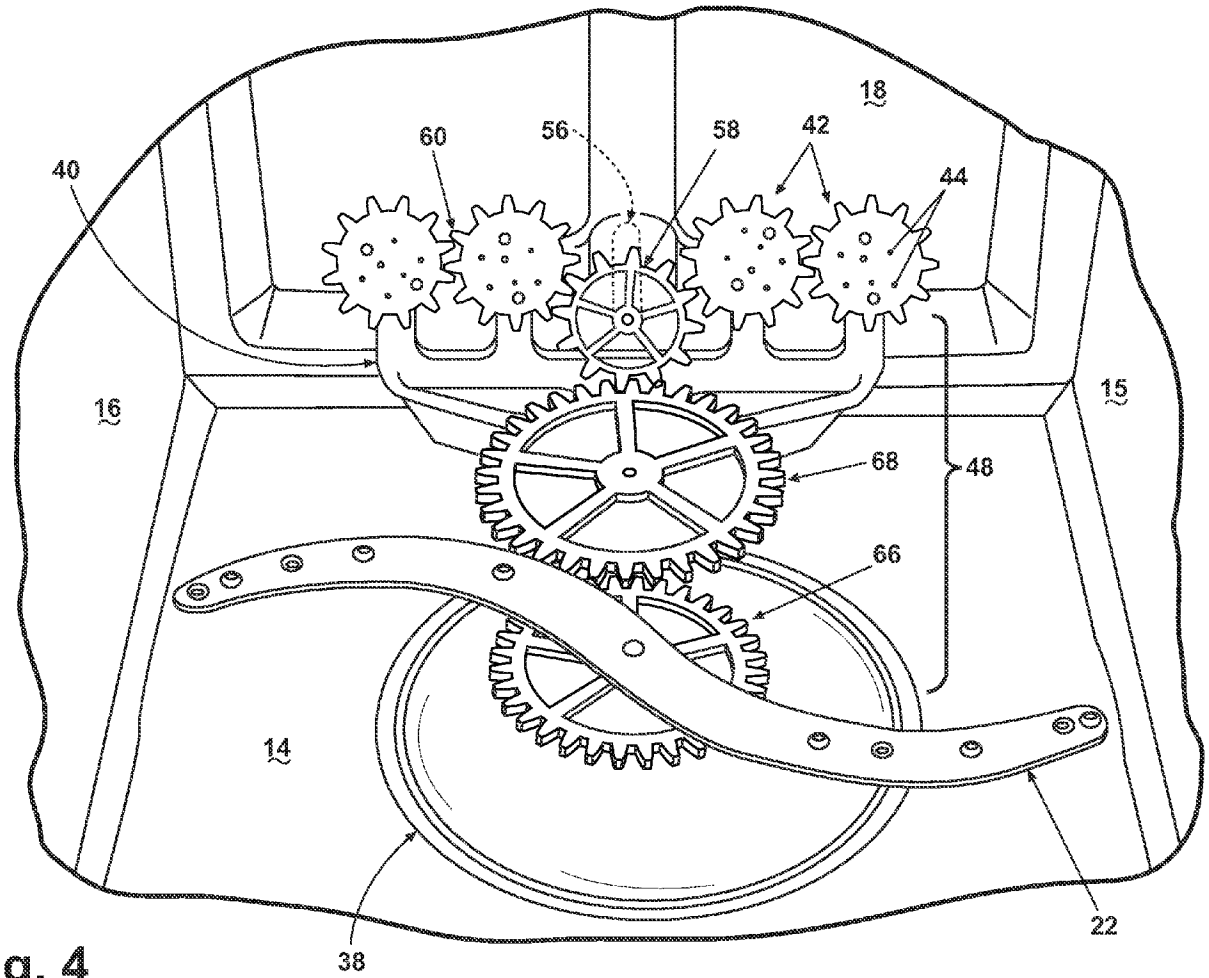
FIG. 4 is an enlarged perspective view of the drive link coupled to the sprayers and the bottom spray arm according to the first embodiment.

Referring now to FIG. 4 which is an enlarged perspective view of the drive link 48 according to the first embodiment. The drive link 48 couples at least one of the plurality of rotatable sprayers 42 with the lower spray arm 22. The number of sprayers 42 can be selectively varied, as well as the height and positioning of each sprayer 42.

Each rotatable sprayer 42 may be implemented as a sprayer head with at least one spray opening 44. Each opening 44 may have any suitable shape, size, number, arrangement and angle orientation with respect to the spray head 42 or with respect to the spray manifold 40. The manifold 40, spray heads 42 and wash liquid supply system may further be provided with other components such as circular front and back plates of the spray head, a wash liquid valve, etc. Those components are not germane to the present invention and therefore will not be described in detail herein. However, a detailed description of those components may be found in commonly assigned U.S. Patent Publication No. US 2005/0150529 to Vanderroest et al., incorporated here in its entirety.

The drive link 48 may be of any suitable type, such as for example, a crank, a gear, a gear train, a gear belt or a may be a combination of thereof. The drive link 48, according to this embodiment, has the driver 50 (FIG. 2) actively rotating the plurality of the sprayers 42 via an optional drive gear 58 attached to the shaft 56. The drive gear 58 may have any suitable configuration and size and may be directly or indirectly coupled with one or more sprayers 42. Each sprayer 42 may have a circumferential engagement surface 60 as a part of the drive link 48. The circumferential engagement surface 60 may have a plurality of teeth for mutual gear engagement of the sprayers 42 with each other and with the optional drive gear 58. The gap between teeth may be selected to lessen soil build-up during the operation of the dishwasher 10. During operation of the dishwasher 10, a rotation speed of sprayers 42 is controlled by the speed of the driver 50 and by the gear ratios employed in the design. A gear train may be provided having the first drive gear 58 carried by the shaft 56, a second gear 66 carried by the lower spray arm 22, and an optional third idler gear 68 operably coupling the first and second gears 58, 66. The drive link 48 may be operably coupled to and drive one of the first, second and third gears 58, 66, 68.

Figure 5:
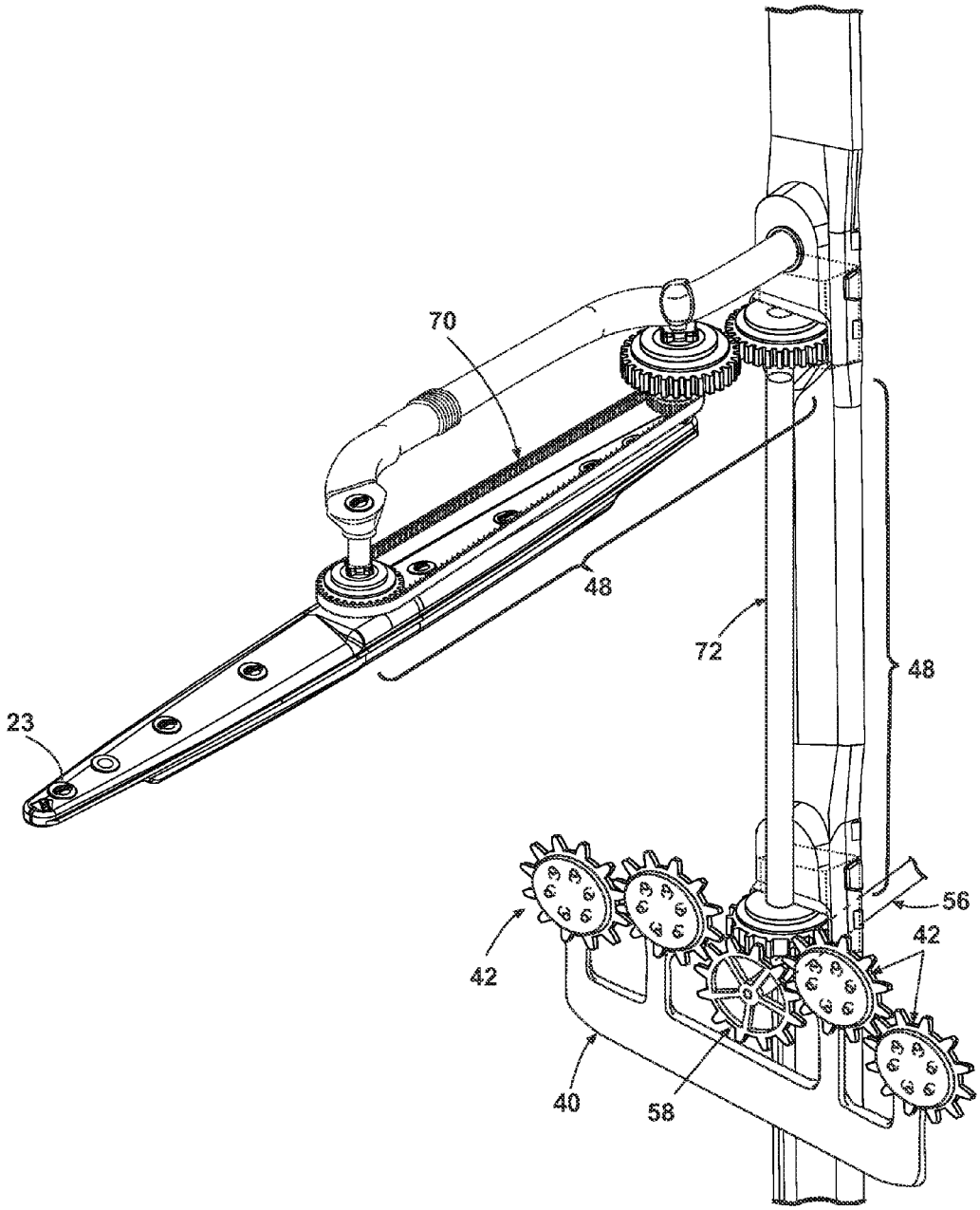
FIG. 5 is a perspective view of the drive link structure coupling the sprayers and the middle spray arm forming a second embodiment of the invention.

Referring now to FIG. 5 there is illustrated a second embodiment of the drive link 48 coupled with at least one of the shown plurality of rotatable sprayers 42 and the middle spray arm 23. The drive link 48 of this embodiment has a gear belt 70 coupled with a secondary geared shaft 72, which in turn is rotated by the optional drive gear 58. Thus, the middle spray arm 23 is simultaneously rotated with the sprayers 42 driven by the optional drive gear 58 coupled with the drive shaft 56 of the driver 50 (FIG. 2). Additionally, the lower spray arm 22 may be also coupled with at least one of the sprayers 42 as shown in the first embodiment (FIG. 4).

Figure 6:
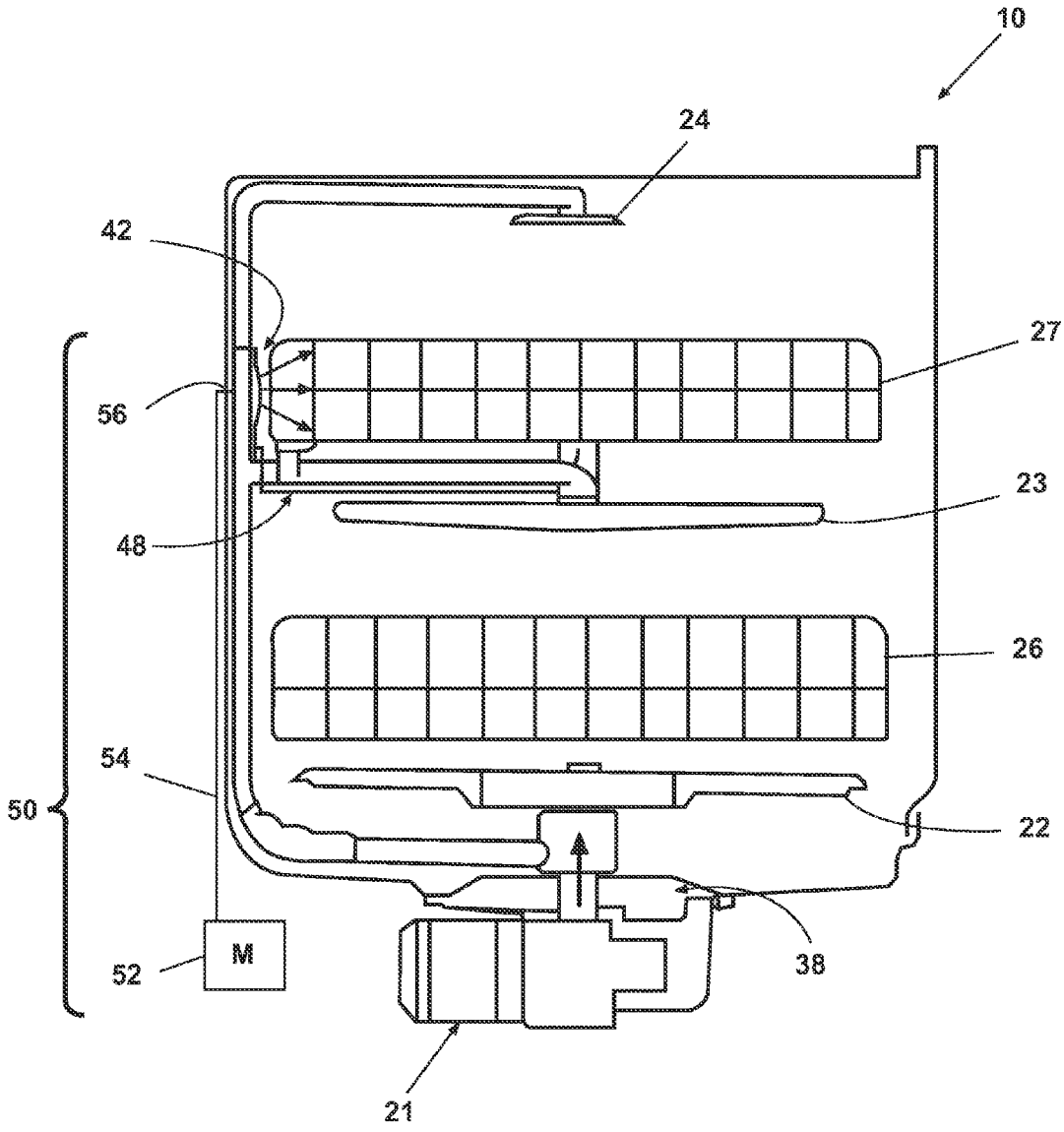
FIG. 6 is a schematic, cross-sectional view of the sprayers at a different location forming a third embodiment of the invention.

FIG. 6 demonstrates a third embodiment of the invention, having the manifold 40 moved up vertically along the wash liquid supply tube 25 to a position adjacent the upper dish rack 27. Similar to the second embodiment, the drive link 48 may be coupled with at least one of the rotatable sprayers 42 and the middle spray arm 23. Alternatively or additionally, the drive link 48 may couple the at least one of the rotatable sprayers 42 with the lower spray arm 22, or with both the middle and the lower spray arm 23, 22.

The spray manifold 40 is not limited to this configuration; rather, the spray manifold 40 can be located in virtually any part of the interior tub 12. Alternatively, the manifold 40 can be positioned beneath the lower dish rack 26 adjacent or beneath the lower spray arm 22. The spray manifold 40 can also extend across virtually any width of the interior wash tub 12, or can be limited to extending to only one side of the supply tube 25. Moreover, the driver 50 may be coupled with at least one of the sprayers 42, which in turn is coupled with any movable part of the dishwasher 10 and/or with any or all spray arms 22, 23, 24. Alternatively, the driver 50 may be coupled with any movable part of the dishwasher 10, which in turn is coupled with the sprayers 42 via a suitable drive link 48.

Figure 7:
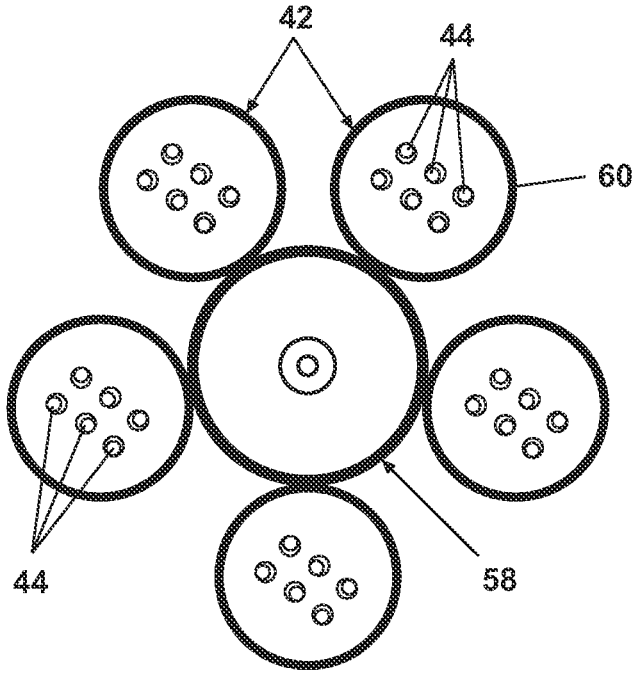
FIG. 7 is a schematic view of the sprayers with an alternative circumferential engagement according to a forth embodiment.

As illustrated in FIG. 7, the circumferential engagement surface 60 may be a substantially smooth surface made of a suitable material for mutual friction engagement of each sprayer 42 and the optional drive gear 58. Any high friction material is suitable for the engagement surface 60, with rubber being one non-limiting example of the suitable material. FIG. 7 also illustrates a different arrangement of the sprayers 42, where all sprayers 42 are directly coupled with the drive gear 58.

As described above, the driver 50 actively controls the rotation of the sprayers 42 and any movable part coupled to the at least one sprayer 42. This active control of the sprayers 42 and one or more spray arms 22, 23, 24 provides additional opportunities for improved washing action of the dishwasher 10. Moreover, the active control of the sprayers 42 and one or more spray arms 22, 23, 24 at a variety of speeds enhances the cleaning effectiveness of the zone wash sprayer. The rotation of the wash liquid stream covers a greater soil area with less volume of wash liquid. Because less wash liquid is used, increased wash liquid pressure is maintained at all zones and sprayers, thereby enhancing the overall cleaning effectiveness of the dishwasher 10. A reverse direction of rotation of the sprayers 42 and the spray arms 22, 23, 24 also subjects soil particles on utensils and dishes to streams of wash liquid that approach the particles from different directions. This enhances the lifting and removal of soil particles from the utensils and dishes.

While the present invention is described in terms of a conventional dishwashing unit as illustrated in FIG. 1, it can also be implemented in other types of dishwashing units such as in-sink dishwashers or drawer dishwashers. For both the in-sink and drawer-type dishwashers, the tub is oriented such that the open face is upward. The cabinet functions as the door for the drawer-type dishwasher, wherein the sliding of the drawer relative to the cabinet selectively closes the open face.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. An automatic dishwasher configured to perform a cycle of operation to clean utensils comprising:

a tub defining a wash chamber having an open face for receiving utensils for washing, wherein the tub comprises a bottom wall and a rear wall extending from and perpendicular to the bottom wall;

a closure element for closing the open face;

a first dish rack located within the wash chamber and comprising a bottom and a peripheral side wall extending upwardly from the bottom;

a rotatable spray arm provided on the bottom wall beneath the first dish rack and having a primary spray passing through the bottom of the first dish rack to define a first wash zone in the wash chamber;

at least one rotatable sprayer provided on the rear wall and having a primary spray defining a second wash zone in the wash chamber;

a drive link coupling the rotation of the rotatable spray arm and the at least one rotatable sprayer; and a driver coupled to and moving one of the rotatable spray arm, the at least one rotatable sprayer, and the drive link, and thereby simultaneously rotating the rotatable spray arm and the at least one rotatable sprayer.

2. The automatic dishwasher of claim 1, further comprising multiple rotatable sprayers, which are rotationally coupled such that rotation of one rotatable sprayer rotates the other rotatable sprayers.

3. The automatic dishwasher of claim 2, wherein the drive link rotationally couples the rotatable sprayers.

4. The automatic dishwasher of claim 2, wherein the drive link is coupled to less than all of the rotatable sprayers.

5. The automatic dishwasher of claim 2, wherein each of the rotatable sprayers has a primary spray, and the collection of the primary sprays of the rotatable sprayers defines the second wash zone.

6. The automatic dishwasher of claim 1, wherein the primary spray of the at least one rotatable sprayer extends into the first dish rack to locate the second wash zone in an area bounded by the peripheral side wall of the first dish rack.

7. The automatic dishwasher of claim 6, wherein the primary spray of the at least one rotatable sprayer passes through a portion of the peripheral side wall to locate the second wash zone immediately adjacent the portion of the peripheral side wall.

8. The automatic dishwasher of claim 1, wherein the first and second wash zones overlap to define a third wash zone.

9. The automatic dishwasher of claim 8, wherein the third wash zone has at least one of a greater intensity, pressure, and volumetric flow rate than each of the first and second wash zones.

10. The automatic dishwasher of claim 1, further comprising a second dish rack having a peripheral side wall located in an upper portion of the wash chamber, wherein the second wash zone is located within the area bound by the peripheral side wall of the second dish rack.

11. The automatic dishwasher of claim 1, wherein the driver further comprises a motor.

12. The automatic dishwasher of claim 1, wherein the drive link comprises a gear train.

13. The automatic dishwasher of claim 12, wherein the gear train comprises a first gear carried by the rotatable spray arm and a second gear carried by the at least one rotatable sprayer.

14. The automatic dishwasher of claim 13, wherein the gear train further comprises a third gear operably coupling the first and second gears.

15. The automatic dishwasher of claim 14, wherein the drive link is operably coupled to and drives one of the first gear, second gear, and third gear.

16. The automatic dishwasher of claim 1, wherein the at least one rotatable sprayer comprises a plurality of rotatable sprayers, with at least some of the plurality of rotatable sprayers being rotatably coupled such that rotation of one of the rotatable sprayers effects the rotation of the other rotatably coupled, rotatable sprayers.

17. The automatic dishwasher of claim 16, wherein each of the rotatably coupled, rotatable sprayers comprise circumferential engagement surfaces.

18. The automatic dishwasher of claim 17, wherein the circumferential engagement surfaces comprise at least one of a frictional surface for mutual friction engagement and a plurality of teeth for mutual enmeshed engagement.

19. The automatic dishwasher of claim 16, wherein each of the plurality of rotatable sprayers comprises a rotatable spray head in fluid communication with a spray manifold, which is fixed within the tub.

20. The automatic dishwasher of claim 1, further comprising a pump assembly to supply liquid to the rotatable spray arm, wherein the drive is independent from the pump assembly.

* * * * *